US005082711A

United States Patent [19]

Goerens

[11] Patent Number: 5,082,711

[45] Date of Patent: Jan. 21, 1992

[54] FLOCKED YARN

[75] Inventor: Robert L. Goerens, Esch/Alzette, Luxembourg

[73] Assignee: Uniroyal Englebert Textilcord S.A., Steinfort, Luxembourg

[21] Appl. No.: 517,536

[22] Filed: Apr. 26, 1990

Related U.S. Application Data

[63] Continuation-in-part of Ser. No. 315,556, Feb. 24, 1989, abandoned.

[30] Foreign Application Priority Data

Feb. 27, 1988 [DE] Fed. Rep. of Germany ..... 3806275

[51] Int. Cl.[5] ..... B05D 1/04; B05D 1/14; B32B 3/02; D02G 3/00

[52] U.S. Cl. ..... 428/90; 427/25; 427/26; 428/92; 428/97; 428/375

[58] Field of Search ..... 428/90, 85, 97; 427/25, 427/26

[56] References Cited

U.S. PATENT DOCUMENTS

| | | | |
|---|---|---|---|
| 3,583,890 | 6/1971 | Kolckmann | 428/90 |
| 4,014,648 | 3/1977 | Walsh et al. | 427/26 |
| 4,293,604 | 10/1981 | Campbell | 428/90 |
| 4,560,604 | 12/1985 | Shimizu et al. | 428/90 |
| 4,724,664 | 2/1988 | Goerens | 427/26 |
| 4,781,951 | 11/1988 | Kitamura et al. | 428/90 |

*Primary Examiner*—Jenna Davis
*Assistant Examiner*—James D. Withers
*Attorney, Agent, or Firm*—Robert W. Becker & Associates

[57] ABSTRACT

A flocked yarn that is formed from a carrier thread with an adhesive coating, and flock that is disposed therearound. The flock is in the form of a flock mixture that includes at least polyamide and polyester flock. The polyester flock assures a high fastness of light for the flocked yarn. To improve the properties of use, the flocked yarn can also be provided with a certain amount of aramid flock.

12 Claims, 4 Drawing Sheets

FLOCKED YARN

This is a continuation-in-part of copending parent application Ser. No. 315,556 Goerens filed Feb. 24, 1989, now abandoned to the assignee of the present invention.

BACKGROUND OF THE INVENTION

The present invention relates to a flocked thread or yarn that comprises a brightened or finished carrier thread with an adhesive coating and treated flock that is electrostatically introduced into the coating. The flock is of specific yet selectable denier, length, and density, and is disposed all around and essentially radially on said carrier thread/coating.

The heretofore known, frequently used flocked yarn comprises a carrier thread, and, due to its good properties of use, polyamide flock. This flocked yarn has a relatively high resistance to wear and abrasion. The ability of the yarn to resist bleaching, i.e. the fastness to light, is improved by using suitable dyes and by UV-stabilizers. Generally, the tips of the polyamide flock are affected by the rays of the sun. However, the fastness of such flocked yarn to light is capable of being improved.

It is known that polyester material has a considerably better fastness to light than does polyamide material, and has a greater ability to resist bleaching over time. However, polyester is not as resistant to wear or abrasion as is polyamide material.

It is therefore an object of the present invention to improve the fastness of flocked yarn to light by using suitable material, while at the same time essentially maintaining the good physical properties of resistance to wear and abrasion.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
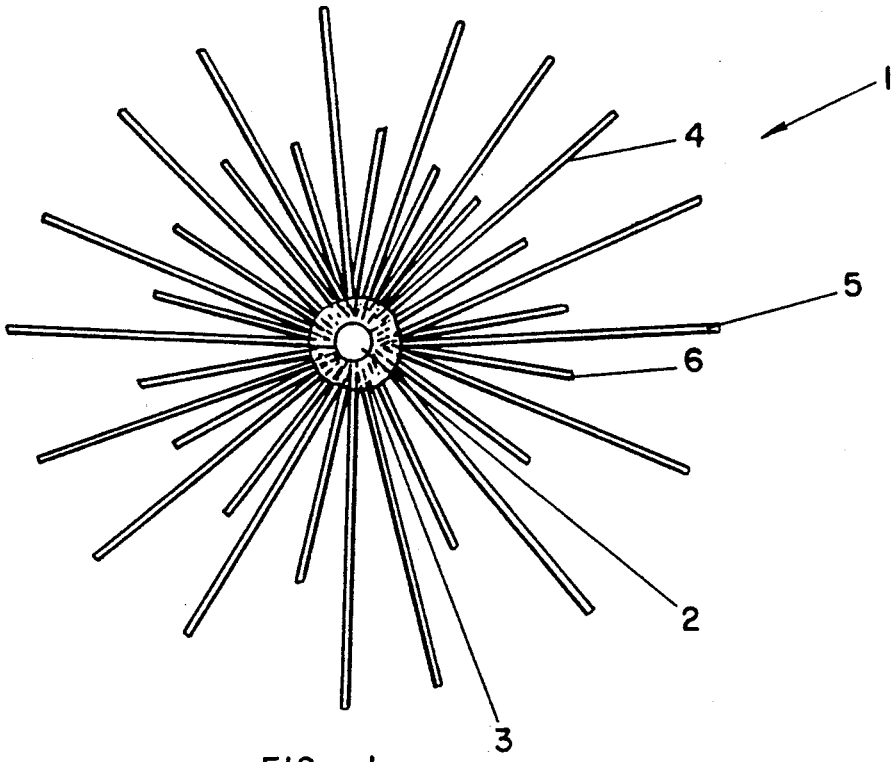
FIG. 1 is a cross-sectional view through one exemplary embodiment of the inventive flocked yarn.

The flocked yarn of the present invention is characterized primarily in that the flock comprises different materials, including polyester flock and polyamide flock; this so-called mixed flock or flocked mixture is distributed uniformly on the carrier thread/coating. As a result, an improved fastness to light is imparted to the flocked yarn as a result of the presence of polyester flock.

The statistical distribution can be 50% polyester flock and 50% polyamide flock. The arrangement of the inventive flock of these different materials is to be such that polyester flock fibers and polyamide flock fibers are respectively alternately disposed next to one another. Treatment measures known in the flocking industry, and existing means and methods for flocking all the way around, are suitable for this purpose.

Depending upon the later application of the inventive flocked yarn, the distribution of the flock mixture, for example, can be 70% polyamide flock and 30% polyester flock. This represents an example of use for upholstery fabric. However, the distribution, for example, also can be 30% polyamide flock and 70% polyester flock. This would represent examples of use for wall coverings and, in the automobile industry, side door coverings, the inside of roofs, and the back seat ledge or rear window deck.

The fastness of the polyester to light thus advantageously improves the flocked yarn product. Cost advantages are also associated herewith, because polyester is relatively economical with regard to raw material and manufacturing costs. The inventive flocked yarn, which is provided with a flock mixture of polyamide and polyester, is not only elastic and resilient, but is also provided with a fastness to light and is economical.

It is also possible to achieve a further improvement of the flocked yarn. This relates to the carrier threads, which can similarly be made of polyester material. Preferably associated with this carrier thread is a flock mixture that is provided with different lengths of cut for polyester and polyamide. In particular, the length of cut of the elastic, resilient polyamide is preferably somewhat longer than that of the polyester flock. Preferred lengths are 1.1 mm for the polyamide flock and 0.7 mm for the polyester flock. In this connection, both of the flock materials can have the same denier, for example having a fineness of 3.3 decitex.

Where the deniers are different, the polyamide flock can have a fineness of, for example, 3.0 decitex, and the polyester flock can have a fineness of, for example, 1.7 decitex. As a result of this inventive feature, a densely flocked yarn of mixed flock is obtained that via the length and denier of the polyamide flock assures a good resistance to wear and abrasion, and via the length and denier of the polyester flock assures a very good fastness to light.

If the flocked yarn is subjected to unusually high mechanical and thermal stresses, and yet is at the same time to have a fastness to light, the flock mixture can, in addition to polyamide and polyester flock, also contain aramid flock.

The physical properties of the aramid flock make it particularly suit able for improving the tensile and compressive strength, the braking strength, and the modulus of elasticity of the flocked yarn. In this connection, the length of cut of the aramid flock is less than that of the two other types of flock that are used, namely the polyamide and polyester flock.

Further specific features of the present invention will be described in detail subsequently.

DESCRIPTION OF PREFERRED EMBODIMENTS

Referring now to the drawing in detail, the flocked thread or yarn 1 of FIG. 1 is provided with a carrier thread 2 of polyester. Also provided is an adhesive coating 3 of acrylate.

The flock 4, which is disposed essentially radial to and all the way around the carrier thread 2, comprises polyamide flock 5 having a length of cut 1.1 mm and a 3.3 decitex fineness, and polyester flock 6 having a length of cut of 0.7 mm and a fineness of 3.3 decitex. The polyamide flock makes the flocked yarn elastic and flexible, and the polyester flock provides the flocked yarn with a fastness to light. The two types of flock, namely the polyamide flock and the polyester flock, are each present in a 50% proportion.

Figure 2:
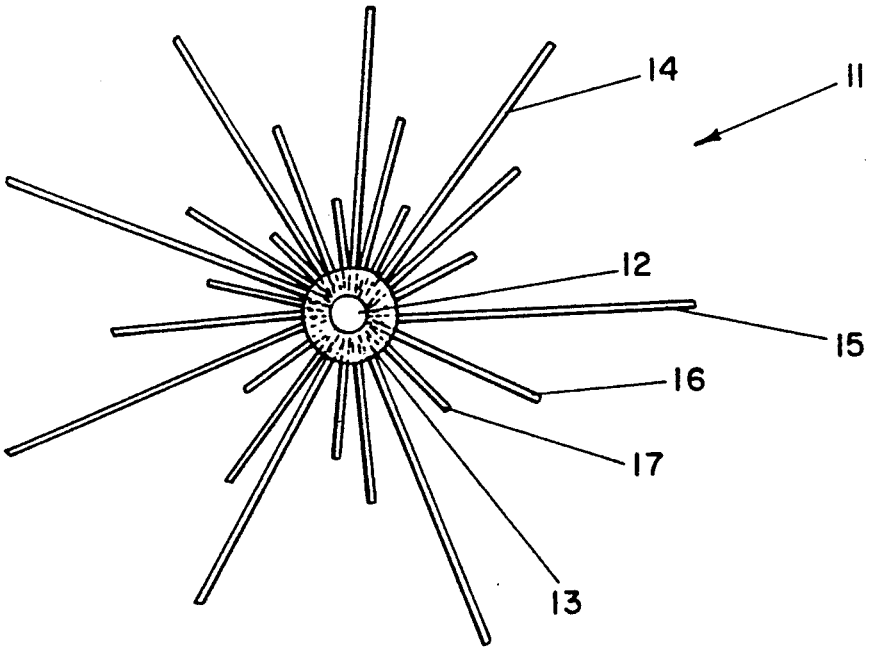
FIG. 2 is a cross-sectional view through a second exemplary embodiment of the inventive flocked yarn.
Figure 3:
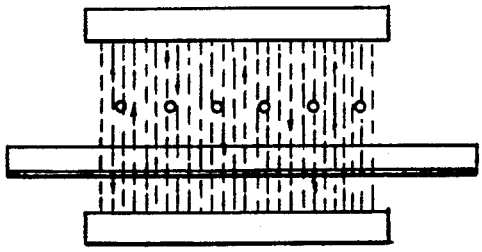
FIG. 3 is a view showing a diagrammatic representation of electrodes and field lines effective upon carrier threads.
Figure 4:
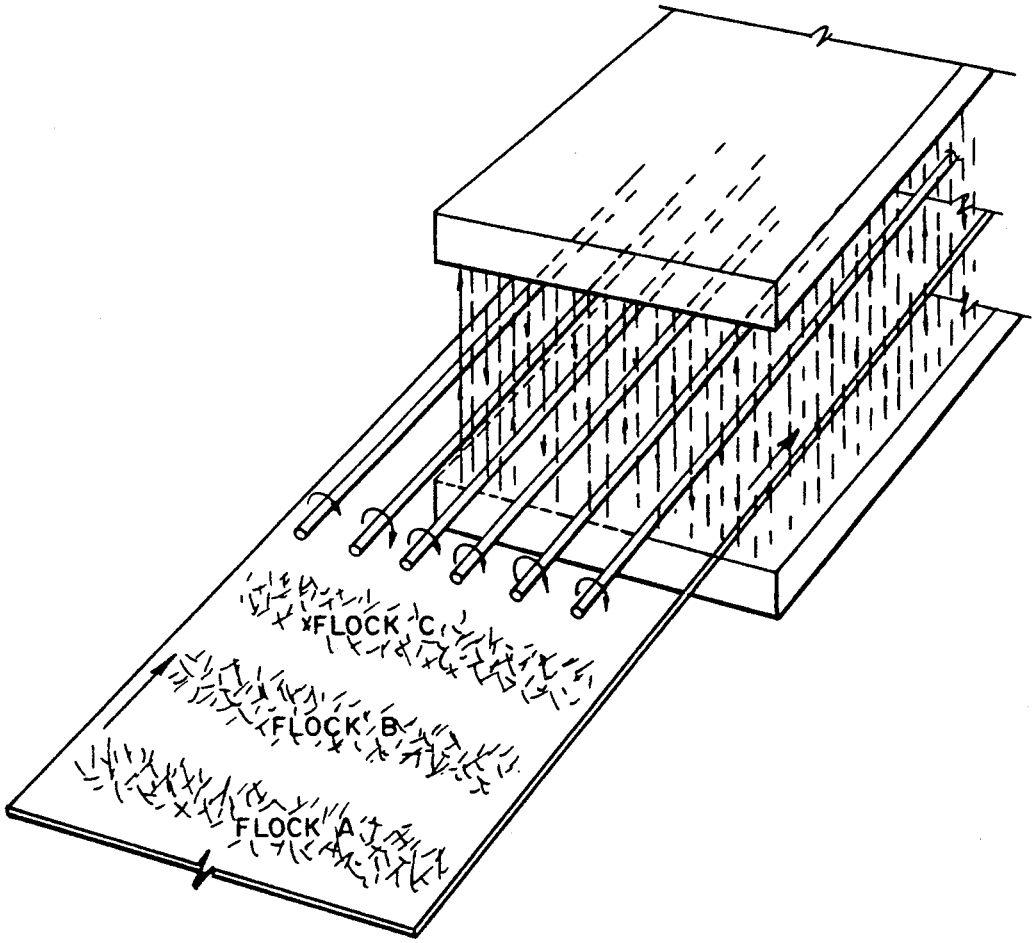
FIG. 4 is a fragmentary perspective view of the representation of FIG. 3 further including different flock "a", "b" and "c" applied in an electrostatic field.
Figure 5:
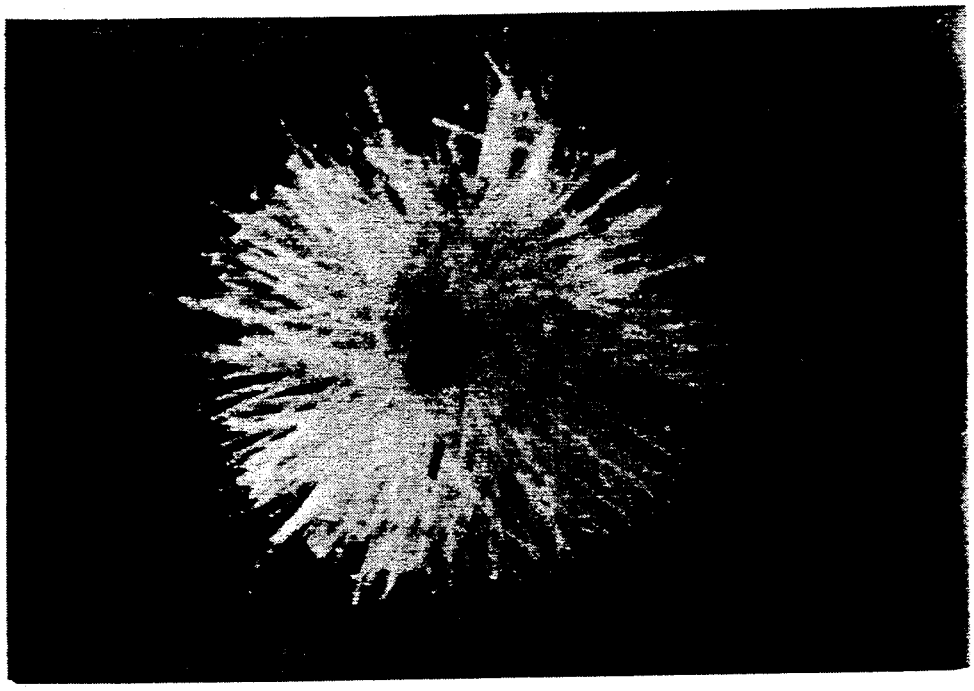
FIG. 5 is an end view of an enlarged microscopic picture showing all around flocking only with polyamide flock of same length.
Figure 6:
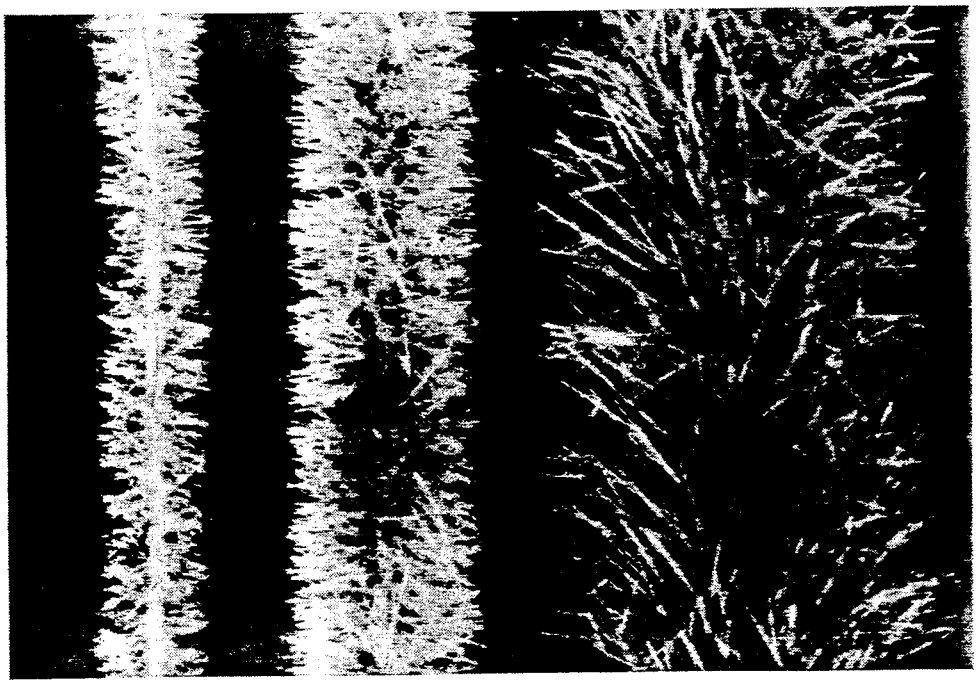
FIG. 6 is an enlarged side view of differently enlarged microscopic pictures of the flock thread of FIG. 5 in three different enlargements for flock of polyamide equal length.

In the embodiment of FIG. 2, the flocked yarn 11 comprises a rayon thread 12 with an adhesive coating 13 of acrylate and a flock mixture 14. In this embodiment, the flock mixture comprises 1.1 mm long polyamide flock 15, 0.7 mm long polyester flock 16, and 0.4 mm long aramid flock 17. Since the polyester flock is utilized due to its great fastness to light, it plays no significant part in the strength of the flocked yarn, which is achieved by the two other types of flock, namely the polyamide flock and the high-strength aramid flock, and can therefore have a finer denier than the polyamide and aramid flock.

The use of the inventive flocked yarn with a flock mixture for an improved ability of the yarn to resist bleaching over a period of time is not limited to the aforementioned examples of upholstery fabrics or automobile fabrics, but rather can be advantageously used anywhere where the ability of the fabric to resist bleaching is important.

The present invention is directed thereto that a flock mixture is formed via which several good use characteristics are attained which otherwise would not be possible.

The flock consists of or comprises different materials. This means that a "flock mixture" is proposed for reasons to obtain simultaneously different good characteristics and having advantages and being preferred over the previously known flock threads or yarn.

A flock yarn of the present invention is characterized primarily in that the flock comprises different materials, including polyester flock and polyamide flock; this so-called mixed flock or flock mixture is distributed substantially uniformly on the carrier thread/coating. In accordance with the present inventive improvement features there must be noted that a multiplicity of technically possible flocked fibers meaningful to employ or use are meant in relation to the differing flocked material as disclosed and at least polyester flock and polyamide flock are included therewith.

This does not preclude that already certain types of flock, for example aramid, are also already provided in the flock mixture. There can be pointed out that especially and particularly selected are named polyamide because of the high wear resistance thereof and polyester because of the high ability of the yarn to resist bleaching.

The flock mixture is not restricted or limited to these two materials. Subsequent reference to the additional flock material polyamide can be taken as basis that more than two flocked materials are to be understood to be meant when referring to flock mixture.

The present invention concerns a product which encompasses flock threads of flock mixture. How this is attained is initially secondary in meaning. The present day flocking technique is in a position to produce flock mixture threads and how this occurs would be a method disclosure and there must be pointed out respectively that the present case is not directed to any method or procedure on how to produce the same.

For example several possibilities exist as set forth in the following paragraphs.

EXAMPLE 1

A flock mixture of 70% polyamide and 30% polyester is provided. For this there is noted that the polyester and polyamide are "premixed" in the aforementioned ratio or relationship. If these flocked fibers have the same titer and the same flock length, a uniform preparation medium is to be employed. The so-premixed flock mixture is accelerated electrically in an electrostatic comparatively uniform manner and likewise "occupying" uniformly the carrier threads.

EXAMPLE 2

A flock mixture of 70% polyamide flock and 30% polyester flock is again provided. Hereby the flock lengths however are different, since the polyamide flock is for example 1.0 mm long and the polyester flock is for example 0.7 mm long. The different mass weights resulting hereby are taken into consideration already during the selection of the preparation medium or means. These means likewise are different. There are preparations which on the one hand make possible the electrostatic flocking and additionally prevent or avoid a de-mixing and which on the other hand as is essential, to bring about acceleration of the flocked fibers via the electrostatic application such that the heavier, longer polyamide fibers are not moved essentially faster and not slower than the somewhat lighter, shorter polyester fibers.

With the technically possible dense flocking of a carrier thread via electrostatic flocking there is noted that the statistical distribution of polyamide and polyester flock whether having the same titer and/or equally long or of different length, is so good that there can be mention made as to a uniform distribution.

When having a flocked mixture of 50%:50% polyamide and polyester there must be taken into consideration that not every polyamide fiber is arranged next to or adjoining a polyester fiber. This is not absolutely attainable. However there is important that the flock thread has both flock mixture fibers in such a good distribution, that the use characteristics mentioned in the specification are attained and maintained an optimum over the "textile fabric or weave life or durability".

EXAMPLE 3

A flock mixture of ⅓ polyamide, ⅓ polyester and ⅓ aramide is provided. Presuming that these different flock materials are different in titer and different in the fiber length thereof, then for that three different preparations are required so that the different flocks in accordance with the goal or object strived for, have the carrier thread with uniform distribution.

Here there is proceeded for example in such a manner that the prepared aramid flock is flocked initially upon the carrier thread under predetermined, selectable preconditions of electrostatic type such as electrovoltage or power.

Then a premixture of respectively ⅓ polyamide and ⅓ polyester is subsequently flocked in a further flocking phase under somewhat different electrostatic conditions. The "gaps" between the aramid flock already occupying the carrier thread are now occupied by the premixed and electrostatically identically placed polyamide and polyester flock in a manner such that upon obtaining full density there exists a good distribution within the meaning of uniformity.

EXAMPLE 4

There is provided a flocked mixture of 60% polyamide with a length 1:1 mm and a fineness of 3.3 dtex, 30% polyester with a length of 0.7 mm and a fineness of 3.3 dtex as well as 10% aramid having a length of 0.4 mm and fineness of 4.2 dtex can be provided. Different preparations are necessary and required. The carrier or transporting band or thread which leads into the flocking chamber first receives a "carpet" of premixed flock mixture that consists of 60% polyamide and 30% polyester. This premixture is accurately and exactly put together or compiled and exactly or accurately dosed as delivered upon the transporting band or thread. Upon this "premixture flock carpet" there is likewise delivered the 10% aramid flock distribution likewise accurately or exactly dosed.

With the electrostatic flocking there is noted that as to time and acceleration first the aramid flock moves "as located on top" and these occupy the carrier thread. On the other hand, in time and in acceleration the polyamide flock and polyester flock will move partially with the aramid flock and partially after the aramid flock in such a manner as to the prepared "carpet" of the flock mixture permits. The so-obtained flock mixture thread thereupon is exactly and accurately investigated as to whether the desired distribution of flocked mixture upon the carrier thread periphery or circumference and upon the carrier thread length unit exists or does not exist within a predetermined selectable prescribed tolerance. Thereupon the preparation treatments or handling with respect to preparation, premixture, dosing, electrical high voltage and the like are either corrected or not collected as may be necessary.

The object and goal of the invention can be taken to concern a flock mixture thread. The technique permits production of this flock mixture thread. Besides the indicated situations or examples there must be considered to exist a further series of possibilities. It is authoritative, basic and decisive that the flock mixture thread attains the prescribed use characteristics and maintains the same under operating conditions. It is furthermore authoritative, basic and decisive that it is possible to produce a flock mixture thread with flock mixture.

Many possible types of production or manufacture so far as the method and apparatus would be concerned need not be disclosed in the specification of the present case; moreover there can be taken that no new method and no new or novel measures or features but rather only application and employment of known means and measures are involved which are known in the electrostatic flocking technique and these are employed for the flock mixture thread production. It is furthermore known that longer and shorter flock is flocked upon a carrier or support thread. The flock mixture thread which is the best at present for the abrasive or wear resistance, namely polyamide flock, has a somewhat greater length than that applicable for the fastness to light at present the best even though however being more sensitive to wear, namely polyester flock.

In the further pursuing of these features there is noted that the flock more capable of resistance of all should have the shortest flock fiber length because of being more stable and also this has been more valid and applicable in the present situation for the teaching of the present invention.

Thus, the flock mixture of different materials encompasses several flocks and that the feature is directed among those with respect to particular, although selectable selection.

In order to apply flock in a pure polyamide flock, the procedure as previously known is exactly the same as employed during the procedure for attaining the novel product or article in accordance with the present invention. First the carrier thread is flocked less densely. Then with progressive flocking that continues there is noted that the flock density increases still further until a type of "saturation" is attained. This is the condition with which no flock can find any space or room in order to become anchored. This flocking is taken over and employed for mix flocking. The difference now consists therein that the distribution of the different flock means must be examined or scrutinized as to whether the "uniformity" to an adequate extent exists or does not exist in the distribution. Thereafter the different parameters possible are changed or varied more or less or not changed at all until the uniformity is attained.

The electrostatic flocking is a procedure that is known. Basic knowledge about the field-line path and electrode construction and arrangement and about the effect of the particles which come into a power or flux field should be included with the basic knowledge about electrostatic flocking so that these details should not be required to be defined for the method which can be preconditioned as being previously known.

Prior to the present inventive disclosure there did not yet exist any mix-flock thread and consequently there is accordingly to be recognized that a mix-flock thread is to be considered novel which has different flock means, preferably at least two different flock means, provided therewith. So that this mix-flock thread has better characteristic than flock thread of previous embodiments, there is set forth and disclosed a substantial uniformity in the distribution of the mix flock.

With a density disclosed herewith there is noted that the distribution of different flock "a" and flock"b" must be so good that wear resistance and color purity are assured. This however is attainable only with the mix-flock thread as a whole; wear and discoloration result when the surface unity itself involving wear and discoloration are negative factors.

There can be noted that with electrostatic flocking it is not previously capable of being established and fulfilled to anchor flock "a" and flock "b" and flock "c" exactly next to each other but rather it is by chance if this occurs at multiple locations upon the entire thread surface. There can be noted that possibly it may be in error to talk about uniform distribution in such a way that an impression results that at every location this constellation of uniformity must be fulfilled since this is not necessarily always the case. This was not intended to be the impression to be given and it is important that the uniformity is brought about and completed in the form of a mini-island, whereby a sufficient or adequate number of flock "a" and flock "b" and therebetween eventually flock "c" can be taken to exist per island location. Because of the reason of small or nominal wear there will exist practically the wear resistant flock of polyamide remaining always for a longer time when polyamide and polyester form the mix flock.

As background information to facilitate understanding, there can be noted basic factual relationships. The electrostatic flocking is a procedure with which small particles or bodies in the form of a precision-cut short fiber or thread (flock) are moved very fast in an electrostatic field between electrodes. In a situation of yarn or thread flocking, there is noted that the carrier thread provided with an adhesive cover or mantle forms the ground potential into which the rapidly moved short fiber shot therein or thereagainst remains bonded or in a binding relationship.

The strong electrical field with a field strength of several KV/Cm serves therefore to charge the short fibers and to polarize the same and serves furthermore the purpose to transport the short fibers between the electrodes and to permit and allow the short fibers with the required speed to penetrate into the adhesive cover or mantle; furthermore this serves the purpose to orient the short fibers longitudinally of the field line as a consequence of the alternating effect of the charged, polarized short fiber with the electrical field and the aerodynamic resistance.

The degree of orientation is assured and realized in the moment of anchoring of the flock in the adhesive. In the situation of yarn or thread flocking there is noted that this is performed and brought about successfully radially all around the yarn or thread.

The flock thread is externally made so much more uniform and of higher value and the wear resistance is made so much higher in accordance with how much greater the orientation degree of extend is and respectively the greater the number of flock (short fiöers) is applied upon the surface unit which means respectively the higher the density of the flock is caused to be.

During the production of mix-flock yarn or thread the following also is to be taken into consideration: Since the flock consists of different materials there is noted that the specific weights are different and because of the different titer and flock lengths there is noted that the flock masses can be or are different.

Respectively in accordance with the characteristics of the different flocks (material, specific weight, mass) there is provided an identical or different preparation fluid for the different flock so that the transporting speeds are equal of substantially equal. This is capable of being carried out with the known technology in the art of flocking.

The movement of the flock between the electrodes occurs along flux or field lines and terminates in the anchoring in adhesive in a precise although not predeterminable positioning. This means that if a polyamide flock PA 66 with 3.3 dtex titer and 1 mm length and a polyester flock PES with 3.3 dtex titer and 0.75 mm length (with identical preparation of the flock) come into and are moved in the flux or field-line field, then these two flocks with high probability will not "fly" exactly adjacent to each other and also will not be "anchored" exactly next to each other.

If however many of these different flock (short fibers) exist or are at hand then they are so moved and so anchored because of the polarization, orientation and speed, that they are substantially uniformly distributed. Uniformly here refers tot he outer configuration or picture of the flock (short fibers) which are located or stand closely next to each other. The reference to closely or densely next to each other here is to be considered relative under the circumstances; moreover if a further quantity of the different flock (short fibers) additionally is flocked-in, the density becomes still better. This means somewhere the maximum density is at hand and the flock no longer bonds to the adhesive coating and the excess flock is transported away.

The distribution of the different flock is so good that reference is made as to a substantial uniformity of the polyamide flock and polyester flock. This is attainable in different manners. Basically taken there is noted that always a mix-flock thread exists or is at hand with which the flock of different materials (polyamide, polyester, aramid, and other at least polyamide and polyester should be included therewith) there will be substantial uniform distribution on the carrier thread as indicated. This however does not mean that respectively a short fiber of polyamide respectively a short fiber of polyester are located or stand directly next to each other but rather only statistically in a changing or alternating manner.

There can be represented a cross section as set forth in the figures of the drawings. In practice the ideal arrangement may be by change or coincidence so that only mix flock thread patterns are provided and described.

The following can be stated about production of mix flock threads:

a) Different flocks are premixed and kept ready in a storage container.

$a_1$ polyamide, equal titer, long length, quantity 50%

$a_2$ polyester, equal titer, short length, quantity 50%

The electrostatic field is produced. The flock transporting belt is moved and the carrier thread is moved.

The supply container for the flock is opened and a dosed quantity of mix flock comes upon the transporting belt. This mix flock, as soon as it reaches or comes into the field-line effectiveness range, is accelerated in a quantity or volume which lies per surface unit transversely upon the transporting belt as being accelerated along by the transporting belt and being moved with a predetermined speed between the electrodes. A portion of this quantity or volume of mix flock impinges upon the adhesive cover or mantle and is anchored therein. A further portion of the mix flock shoots past or misses the carrier thread and returns back as moved between the electrodes and impinges upon the adhesive mantle or cover and is now anchored therewith. The flock density is now greater than previously with the first quantity or volume thereof. These procedures are repetitive so that the carrier thread is flocked always more tightly or densely.

If now the anchored mix flock per length unit is observed under an electron raster microscope all around and there is counted under circumstances the number of polyamide flock and polyester flock and ascertains a good distribution uniformity, then the thread is maintained in the premixed manner of flock quantity, preparation quantity with the same or identical electrode strength, flock movement speed and speed of the carrier thread and transporting belt relative to each other.

If upon observation under the electron microscope there is ascertained that a desired uniformity of polyamide and polyester flock is not yet at hand, then changes or variations can be undertaken which pertain to the preparation quantity or volume, the field strength, the supply container dosage and other magnitudes. Goal of the production is to attain a uniform distribution of the polyamide flock and polyester flock whereby there can be seen at formed locations for example at one time two polyamide flock adjoining a shorter polyester flock, then again two or three polyamide flock adjoining two shorter polyester flock and then a polyamide flock besides a polyester flock and then for example six polyamide flock next to two polyester flock located or standing closely and densely next to each other. Important is that the distribution of the mix flock in the density all around and upon the thread length is so uniform that the characteristics of wear resistance and light durability are maintained.

There are kept ready as premixed the following:

$a_3$ polyamide of predetermined small titer, long length, quantity 70%

$a_4$ polyester of predetermined greater titer, short length, quantity 30%

The method occurs as described by the foregoing paragraphs. If now there is ascertained that the polyamide and the polyester form "islands", this means that too many polyamide flock exist or are at hand locally or in specific position forms and then changes or variations are undertaken and moreover these can pertain to the preparation, the preparation quantity or volume, the field strength, the supply-container dosage, the speed of the carrier thread and the speed of the transporting belt. If during observation under an electron-raster microscope there is then ascertained an improvement in the distribution within the meaning of uniformity, the change or variation is so undertaken that the desired uniformity is provided or at hand.

b) Different flocks are kept ready as premixed and a flock is kept ready separately.

$b_1$ polyamide of equal titer, long length, quantity 60%

$b_2$ polyester of equal titer, short length, quantity 30%

$b_3$ aramid of each titer, very short length, quantity 10%

The quantity of polyamide and polyester is premixed and kept ready in a supply container. The further supply container contains aramid flock. The electrostatic field is produced. The transporting belt is moved. The carrier thread is moved. The supply container for the aramid flock is opened and a dosed quantity comes upon the transporting belt. This flock is accelerated away or goes along with the transporting belt and occupies the carrier thread.

Then the supply container with mix flock is opened and a dosed quantity of mix flock comes upon the transporting belt. This mix flock is accelerated away or goes along with the transporting belt and now in turn occupies the carrier thread. It is clear that the previously flocked small quantity of aramid has no high density. This results increasingly via the subsequently flocked large quantity mixed flock of polyamide and polyester. The testing or scrutinizing of the density, the distribution of the flock, the speed of the flock, the field strength and the speeds of the transporting belt and carrier thread occurs exactly in the same way as previously described.

Thereafter a possible change or variation of the parameters is undertaken until there is established and determined that the production is now free for many meters of mix flock yarn or thread. The techniques and possibilities of change or variation in themselves cannot be considered to be novel although it has been proven that different mix flock yarn or threads are capable of being produced.

Four sample pieces of mix flock yarn or thread can be noted for example purposes as follows:

1. Sample 0/8921 dark gray consists of the following:
   a) polyamide PA 66, titer 3.3 dtex, length 1 mm, proportion 80%, color nero
   b) polyester PES, titer 3.3 dtex, length 0.75 mm, proportion 20%, color raw white
2. Sample 0/8922 light gray consists of the following:
   a) polyamide PA 66, titer 3.3 dtex, length 1 mm, proportion 40%, color nero
   b) polyester PES, titer 3.3 dtex, length 0.75 mm, proportion 60%, color raw white
3. Sample 0/8866 light blue consists of the following:
   a) polyamide PA 66, titer 3.3 dtex, length 1 mm, proportion 50%, color corn blue
   b) polyester PES, titer 1.7 dtex, length 0.9 mm, proportion 50%, color raw white
4. Sample 0/8867 dark blue consists of the following:
   a) polyamide PA 66, titer 3.3 dtex, length 1 mm, proportion 70%, color corn blue
   b) polyester PES, titer 1.7 dtex, length 0.9 mm, proportion 30%, color raw white The mix flock yarn or thread were subjected to abrasive testing upon a Martindale machine with 40,000 tours. The wear values amounted to slightly less and more than 2%. For comparison purposes, a pure polyamide flock thread as a wear value of 0.3 to 1.5%. A pure polyester flock thread has a wear value of 7.5 to 12%. The optical evaluation of the sample 1 was good and for the samples 2 through 4 inclusive was satisfactory. These samples are now subjected to light purity or fade testing and this is a long time test. After availability of these results the samples are subjected to further tests with respect to the technical yarn or thread having conventional use or employment characteristics. At the end there will be set forth which sample collectively meets the requirements. There is determined that mix flock yarns or threads according to the present inventive teaching are producible with a substantially uniform distribution of different flocks.

With respect to the feature "uniform distribution" there may be needed a clarifying supplementing of the wording to make reference to distribution of the different flock within a predetermined, although selectable tolerance in the number of individual flock relative to each other via which the improved light durability with high wear resistance is obtained and assured.

The flocked yarn consists of a finished carrier thread with an adhesive coating applied on surfacing of the thread and treated flock that is electrostatically introduced as propelled into said adhesive coating; the has specific yet selectable denier, length, and density, and is disposed essentially radially all around on said carrier thread/coating; the flock is a flock mixture that comprises different materials, among them including particularly polyester flock having considerable fastness to light and polyamide flock having resistance to wear and abrasion, with said flock mixture being distributed substantially radially in a predetermined closeness and density for surface unity all around on said carrier thread/coating as electrostatically introduced and propelled into the coating. The flocked yarn is a product employed for wall coverings and as upholstery fabric, in the automobile industry, for side door coverings, inside of roofs, back seat ledges as well as rear decks at locations requiring relatively high resistance to wear and abrasion as well as fastness to light attained due to distribution of the flock mixture of different materials being within predetermined though selectable tolerance value of said individual flock of different materials relative to each other via which improved fastness of to light with high resistance to wear and abrasion are simultaneously assured.

The aforementioned four mix-flock yarn or thread samples have features as set forth although with a bare eye this may not be recognizable. An experienced eye recognized that four samples differ from each other when observed under microscopic apparatus. An experienced eye also recognized the "distribution" PA as to PES; flocking density p/mm$^2$. Counting can be undertaken with the aid of an ocular network or scanner-stream method.

Figure 7:
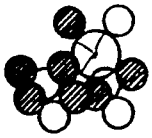
FIG. 7 is a fragmentary schematic view as seen from above upon flock tips also to show islands of several closely located or standing polyamide (PA) flock and polyester (PES) flock.
Figure 8A:
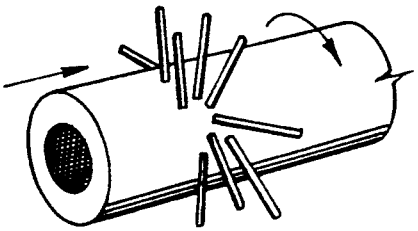
FIG. 8A is a perspective fragmentary view of very short 0.4 mm aramid flock on a carrier thread in a random arrangement attained via electrostatic effect.
Figure 8B:
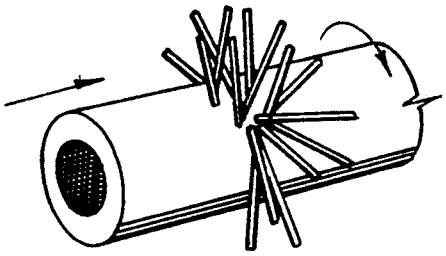
FIG. 8B is a perspective fragmentary view of long 0.7 mm polyester flock on a carrier thread in a random arrangement attained via electrostatic effect.
Figure 8C:
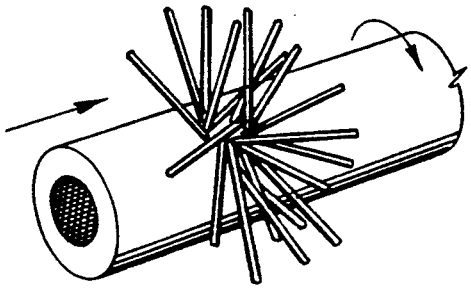
FIG. 8C is a perspective fragmentary view of long 1.0 mm polyamide flock on a carrier thread in a random arrangement attained via electrostatic effect.
Figure 9:
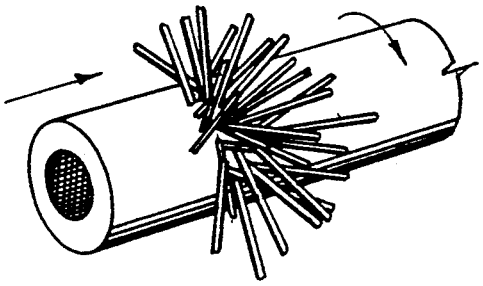
FIG. 9 is a perspective fragmentary view of a mix flock section.
Figure 10:
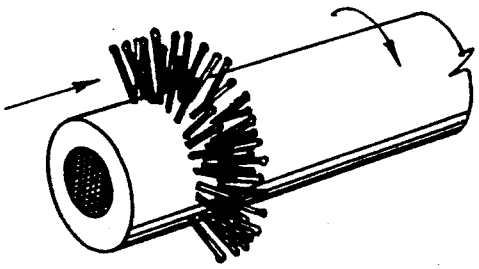
FIG. 10 is a perspective fragmentary view representing progressive density of mix flock on a carrier thread having an adhesive cover thereon.

The drawing illustrations include perspective views provided with labels to aid understanding threof and to clarify in an example that flock "c" (aramid) is first flocked and subsequently then flock "b" (polyester) and then flock "a" (polyamide) are flocked. Each flock (particle) coming or reaching into the electrostatic field is moved back and forth between the electrodes or either very quickly or after one or up to several times shooting back and forth the flock impinges upon the adhesive mantle or cover of the carrier thread. Each flock particle experiences this same action. The anchoring thus occurs purely coincidentally upon the thread moved longitudinally and turned or rotated respectively. At the beginning there exists a very small or nominal density. With increasing quantity in the increasing flocking time the density becomes always more tight or closer together. This is observable for all three flock types. Mention was made as to "islands" and this can appear as shown in FIG. 7.

Later evaluation ascertained good/satisfactory uniformity in the distribution. If the same is poor, then preparation of the flock can be changed or varied. If the same remains poor, the field strength is changed or varied. If the evaluation furthermore remains poor, all possible parameter changes are undertaken.

Diverging from the illustrated example there can be flocking first with aramid and then a premixture of PA and PES can be flocked. All of these steps per se are not novel. These are known means in the employment or utilization during production of mix flock threads and this must be understood.

Illustrations with accompanying labels can be taken to show illustrated examples how point flocking can be understood to exist. In reality hundreds of flock particles are anchored upon the comparable surface.

The present invention is, of course, in no way restricted to the specific disclosure of the specification and drawing, but also encompasses any modifications within the scope of the appended claims.

I claim:

1. In a flocked yarn that comprises a finished carrier thread with an adhesive coating applied on the surface of the thread and treated flock that is electrostatically introduced into said adhesive coating, with said flock being of specific yet selectable denier, length, and density, and being disposed essentially radially all around on said carrier thread/coating, the improvement wherein:

said flock is a flock mixture that comprises different materials, including polyester flock and polyamide flock, with said flock mixture being distributed uniformly on said carrier thread/coating.

2. Flocked yarn according to claim 1, in which said carrier thread is a polyester thread.

3. Flocked yarn according to claim 2, in which said flock mixture comprises at least polyamide flock and polyester flock, with the length of cut of each specific flock differing from that of the others.

4. Flocked yarn according to claim 3, in which said flock mixture comprises 30 to 70% polyamide flock and 70 to 30% polyester flock.

5. Flocked yarn according to claim 3, in which said flock mixture also includes aramid flock.

6. Flocked yarn according to claim 5, in which the length of cut of said polyamide flock is greater than that of said polyester flock, and the length of cut of said polyester flock is greater than that of said aramid flock.

7. Flocked yarn according to claim 3, in which said polyester flock and said polyamide flock have the same denier.

8. Flocked yarn according to claim 3, in which said polyester flock has a finer denier than do the remaining flocks of said flock mixture.

9. Flocked yarn according to claim 1, in which said polyamide flock and said polyester flock are each present in a 50% proportion.

10. Flocked yarn according to claim 9, in which said polyester flock has a length of approximately 0.7 mm and said polyamide flock has a length of approximately 1.1 mm, both of said flocked materials having the same denier with a fineness of 3.3 decitex.

11. Flocked yarn according to claim 9, in which said polyamide flock has a fineness of 3.0 decitex and said polyester flock has fineness of 1.7 decitex.

12. Flocked yarn according to claim 5, in which said polyamide flock has a length of 1.1 mm, said polyester flock has a length of 0.7 mm and said aramid flock has a length of 0.4 mm, said polyester flock having a finer denier than said polyamide and aramid flock.

* * * * *